United States Patent [19]

Gerbig et al.

[11] 4,146,158

[45] Mar. 27, 1979

[54] APPARATUS FOR THE QUANTITATIVELY MEASURABLE CASTING OF A MOLTEN METAL WITH AN ELECTROMAGNETIC DOSING TROUGH

[75] Inventors: Hans E. Gerbig, Hueckeswagen-Wiehagen, Fed. Rep. of Germany; Lyn L. Socks, Grafton, Wis.

[73] Assignee: Modern Equipment Company, Port Washington, Wis.

[21] Appl. No.: 815,607

[22] Filed: Jul. 14, 1977

[30] Foreign Application Priority Data

Jul. 14, 1976 [DE] Fed. Rep. of Germany ..... 2631575

[51] Int. Cl.[2] ..... B22D 39/00

[52] U.S. Cl. ..... 222/594; 164/147; 164/156; 222/595

[58] Field of Search ..... 164/49, 147, 155, 156, 164/437; 417/50; 222/70, 372, 383, 263, 590, 594, 595

[56] References Cited

U.S. PATENT DOCUMENTS

| | | | |
|---|---|---|---|
| 3,396,870 | 8/1968 | Diamond et al. | 222/595 X |
| 3,610,600 | 10/1971 | Schnake | 222/594 X |
| 3,684,402 | 8/1972 | Stark | 417/50 |
| 3,713,639 | 1/1973 | Starck et al. | 222/594 X |
| 3,834,587 | 9/1974 | Bengt et al. | 222/595 |
| 4,019,563 | 4/1977 | Bergman et al. | 222/595 X |

FOREIGN PATENT DOCUMENTS

| | | | |
|---|---|---|---|
| 352138 | 9/1972 | U.S.S.R. | 164/147 |

*Primary Examiner*—David A. Scherbel
*Attorney, Agent, or Firm*—Meyer, Tilberry & Body

[57] ABSTRACT

Apparatus for accurately pouring measured amounts of molten metal using an electromagnetic elevator. The trough of the elevator obliquely ascends from a pool of molten metal to a pouring spout and controls are provided to maintain the pool level at approximately a constant level so that by accurately repeating the time of the electrical energization of the elevator, the same amount of metal may be poured each time.

2 Claims, 1 Drawing Figure

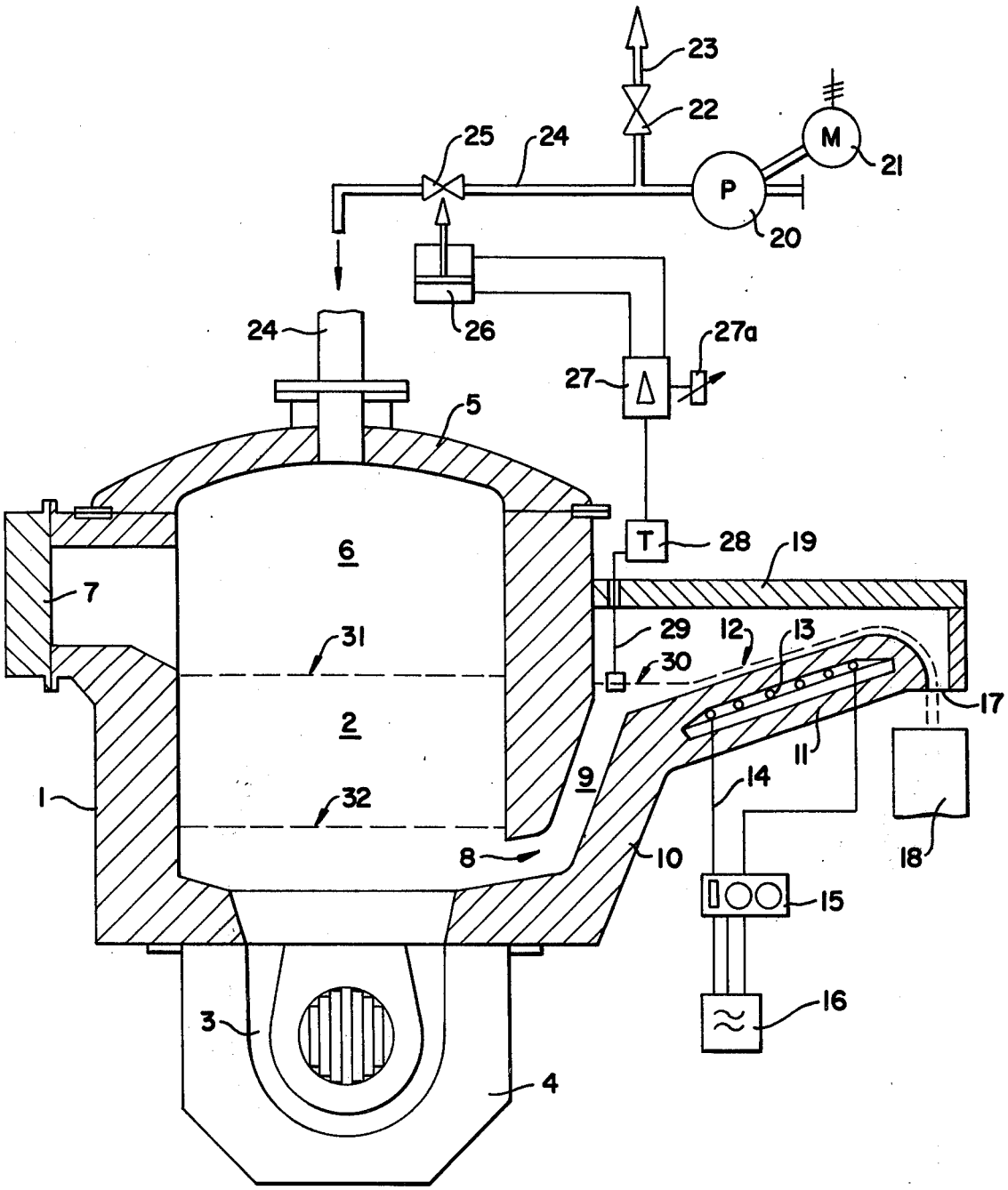
23
22
25
24
M
21
P
20
26
24
27a
27
5
T
28
19
6
7
29
12
13
31
30
17
2
11
9
14
1
32
8
10
18
15
16
3
4

APPARATUS FOR THE QUANTITATIVELY MEASURABLE CASTING OF A MOLTEN METAL WITH AN ELECTROMAGNETIC DOSING TROUGH

This invention pertains to an apparatus for the quantitative measurable casting of a molten metal consisting of a storage tank for storing a supply of the molten metal and of an electromagnetic dosing trough connected to an outlet of the storage tank for the quantitatively measurable delivery of a predetermined quantity of metal from the storage tank to a pouring spout in which the dosing trough transports the metal in open flow from a metal pool by way of a conveying channel obliquely ascending to the pouring spout and dipping into the metal pool.

The storage tank is in known devices of this kind constructed for instance as a melting furnace or a holding furnace to whose furnace chamber the dosing trough with its transport channel is obliquely attached in such a way that the transport channel obliquely dipping into the liquid level of molten metal transports the molten metal in a direction obliquely rising in relation to the horizontal plane to a discharge opening arranged within the transport channel which empties into a casting mold or the like. By connecting and disconnecting the electromagnetic traveling field effecting the transport of the molten metal in the conveying channel, which field is produced by means of a multiphase electromagnetic inductor, the quantities of metal to be supplied to the casting mold can relatively easily be dosed with an appropriate construction of the pouring spout and the dosing trough, in which setup a pure time control of the traveling field or else a control of the traveling field as a function of the filling level of the casting mold in question is made possible.

Inaccuracies which occur on account of the viscosity of the conveyed metal by improper quantities of the liquid metal on the surface of the conveyed metal mass taken along from the bath level are eliminated by constructive measures on the dosing trough which in the first place increase the overall length of the dosing trough.

The invention is concerned with the task of preserving the dosing accuracy of devices of the kind indicated in detail in the beginning particularly in the case of a shortened overall length. Furthermore the dosing of the liquid metal quantities which are delivered to the discharge opening is not influenced by varying incorrect quantities which on account of friction are withdrawn from the pool level.

According to the invention an apparatus of the kind described in the beginning in more detail is provided for this purpose which is characterized in that a control device is provided for keeping the pool level constant in the area in which the transport channel is immersed.

By keeping the level of the pool constant in the area of the submerged transport channel of the dosing trough, the improper quantities which are taken along with the electromagnetically transported metal owing to friction are kept constant, so that they can be taken into account in setting the dosage rate and in the calibration respectively.

The arrangement can be made in equipment according to the invention in such a way that replacement quantities of the liquid metal are supplied to the storage tank depending on the specific quantities taken from it in such a manner that the level of the liquid in the immersion area of the transport channel of the dosing trough is kept constant.

In a further development of the invention, the arrangement is made in such a way that the transport channel of the dosing trough is connected by means of an auxiliary volume of the metal supply communicating with the storage tank to the discharge opening and the control device serves for keeping the pool level of the auxiliary volume constant.

Further in accordance with the invention, the storage tank is tightly closable toward the outside above its metal supply and a regulator controlled in dependence on the pool level is provided for regulating the gas pressure above the metal supply in the storage tank.

The principal object of the invention is a new and improved apparatus for the delivery of molten metal which assures a predetermined amount of metal either repetitively or in individual doses and which is simple in construction and operation.

Another object of the invention is the provision of a new and improved apparatus for the delivery of predetermined amounts of metal using an electromagnetic elevator obliquely ascending from a pool of molten metal to a pouring spout wherein means are provided for continuously maintaining the level of the pool within predetermined limits so that by accurately timing the electrical energization of the elevator, predetermined accurate amounts of metal will always be delivered.

The attached drawing forms a part of this specification and illustrates and serves for explaining the invention on a preferred embodiment of the invention.

In the drawing 1 designates a holding furnace for keeping warm a supply of molten iron 2; 3, a melt trough of an induction-furnace element 4 heating inductively the contents of the furnace; 5, a cover tightly closing the interior 6 of the furnace 1; and 7, a charge door likewise tightly closing the charging aperture of the furnace.

8 designates a discharge opening fitted near the bottom of the holding vessel 1 into it which empties into an upwardly sloping outlet spout 10 serving as a discharge line, defining an auxiliary volume 9. The spout 10 forms with the auxiliary volume 9 a duct communicating with the volume of the heat-preserving vessel 1, which duct extends on the outer wall of the vessel 1 and up to a height which exceeds the maximum level of the molten metal with the storage tank 1.

To the spout 10 is attached a dosing trough 11, known in itself, which consists of a conveying channel 12 obliquely ascending against the horizontal plane, presented in section in the drawing, and an electromagnetic inductor 13 arranged underneath the transport channel 12. The inductor 13 consists in a known manner of multiphase coils supplied with multiphase alternating current, arranged in a slotted stack of magnetic lamination which extends underneath the transport channel along its longitudinal extension and serves for the generation of a linear electromagnetic traveling field progressing in the transport direction of the liquid metal.

The coil of the inductor 13 can be supplied with an alternating current by way of a supply line 14 and an electrical switching and operating mechanism 15 from the electric three-phase main 16.

The transport channel 12 empties into a pouring spout 17 which delivers the liquid metal conveyed by the dosing trough 11 to a casting mold 18 or the like.

The dosing trough 11 is closed by a cover 19 which is arranged at a distance above the transport channel 12.

20 designates a pumping device driven by an electromotor 21 which pumps a gaseous medium through a pipeline 23 containing a throttle 22. To the pipeline 23 is connected a pipeline 24 in which is set up a pressure-regulating valve 25. The line 24 empties through the cover 5 into the pressure chamber 6 of the storage tank 1, and the valve 25 is adjustable by means of a hydraulic piston motor 26 by an electrohydraulic regulator 27. The regulator 27 is controlled by an electric output signal of a measuring feeler 28, which signal is obtained in dependence on the level of the pool of molten metal in the auxiliary volume 9. The measuring feeler 28 cooperates with an appropriate level gauge 29 which picks up the liquid level 30 in the area of the auxiliary volume 9 in which the transport channel 12 dips into the pool level of the auxiliary volume.

The measuring signal of the measuring feeler 28 is compared at the input of the electrohydraulic regulator 27 by means of a control device **27*a* with a nominal value manually adjustable beforehand, and the proper differential signal controls the hydraulic piston motor 26 in such a manner that the gas pressure in the interior 6 of the heat-preserving vessel 1 is adjustable above the supply of molten metal 2 in such a way that the liquid level 30 independent of the withdrawn quantity of melt remains constant. The level of the melt supply in the interior of the holding vessel 1 in such a setup is adjustable between a maximum level 31 and a minimum level 32**.

The described apparatus works as follows: Into the vessel 1 with the charge door 7 open is introduced an appropriate quantity of liquid metal, in which setup the melt reaches the maximum level 31. The door 7 of the vessel 1 is then closed and the pressure in chamber 6 above the level 31 is set by means of the regulator 27 which results in a level of the auxiliary volume 9 in the spout 10 which corresponds to the nominal value preset by means of the control device **27*a*. Thereupon the timing of the switching and operating mechanism 15 is preset on a delivery volume of the liquid metal which corresponds to the specific requirements and the induction coil 13 is energized by connecting it to the three-phase mains, whereupon a proper electromagnetic traveling field is built up in the transport channel 12 and the liquid metal is conveyed out of the auxiliary volume 9 and transported to the discharge opening 17. After a preset period of time the device 15 disconnects again the inductor 15**, so that the transport of the liquid metal is cut off and the dosing operation is discontinued.

During the dosing operation the regulator 27 has by regulating the gas pressure in the interior of the vessel 1, i.e. in the area of the pressure chamber 6, kept the liquid level 30 constant independent of the liquid level in the storage tank 1. As soon as there the level of molten metal drops from its highest surface level 31 to its lowest surface level 32, the storage tank 1 has to be replenished.

It lies within the framework of the invention to modify the apparatus in such a way that the replenishing operation of the storage tank 1 is carried out intermittently or continuously in such a way that the dosing procedure of the apparatus has not to be interrupted.

Having thus described our invention, we claim:

1. Apparatus for the quantitatively measurable casting of a molten metal consisting of a storage tank for storing a supply of said molten metal, an electromagnetic dosing trough connected to an outlet of said storage tank and a pouring spout; said dosing trough transports said molten metal in open flow by way of a conveying channel obliquely ascending to said pouring spout; the improvement which comprises: an auxiliary volume communicating with said outlet of said storage tank and the lower end of said electromagnetic dosing trough and control means for keeping said molten metal at a constant level above the lower end of said electromagnetic dosing through such that said electromagnetic dosing trough may deliver a predetermined quantity of molten metal.

2. Apparatus according to claim 1, wherein said storage tank is tightly closable and pressure sealable toward the outside atmosphere above said molten metal supply and a pressure regulating device is provided for regulating the pressure within said storage tank, said pressure regulating device being responsive to said control device, whereby said molten metal is maintained at a constant level in said auxiliary volume by means of regulating said pressure in said storage tank.

* * * * *